US008120213B2

(12) United States Patent
Hurly

(10) Patent No.: US 8,120,213 B2
(45) Date of Patent: Feb. 21, 2012

(54) ELECTRIC FENCE ENERGISER SYSTEM

(76) Inventor: Leslie Sean Hurly, Johannesburg (ZA)

( * ) Notice: Subject to any disclaimer, the term of this patent is extended or adjusted under 35 U.S.C. 154(b) by 288 days.

(21) Appl. No.: 12/669,123

(22) PCT Filed: Apr. 21, 2008

(86) PCT No.: PCT/ZA2008/000033

§ 371 (c)(1),
(2), (4) Date: Jan. 14, 2010

(87) PCT Pub. No.: WO2009/012505

PCT Pub. Date: Jan. 22, 2009

(65) Prior Publication Data

US 2010/0219699 A1 Sep. 2, 2010

(30) Foreign Application Priority Data

Jul. 17, 2007 (ZA) ..... 2007/06281

(51) Int. Cl.
*H01F 27/42* (2006.01)

(52) U.S. Cl. ..... 307/412; 307/421

(58) Field of Classification Search ..... 307/412, 307/421

See application file for complete search history.

(56) References Cited

FOREIGN PATENT DOCUMENTS

| | | |
|---|---|---|
| AU | 47506 85 | 4/1986 |
| GB | 2 403 856 | 1/2005 |
| WO | 03/026362 | 3/2003 |
| WO | 2007/012090 | 1/2007 |

OTHER PUBLICATIONS

International Search Report issued Oct. 6, 2008 in International (PCT) Application No. PCT/ZA2008/000033.

*Primary Examiner* — Robert L. Deberadinis
(74) *Attorney, Agent, or Firm* — Wenderoth, Lind & Ponack, LLP

(57) ABSTRACT

A method and a system for controlling the operation of an energizer which delivers energy to a fence in the form of a succession of pulses, the energy or waveshape of each pulse is varied in a manner which is dependent on the amount of energy which is lost by the fence for at least one pulse which is applied to the fence.

16 Claims, 10 Drawing Sheets

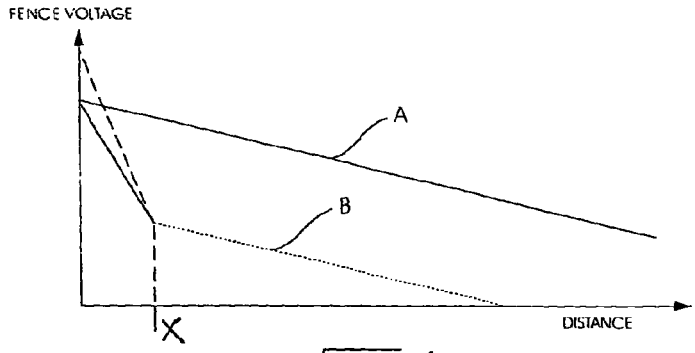
FIG 4
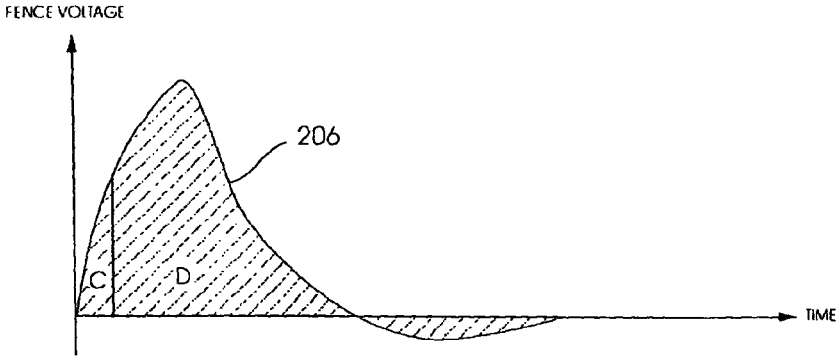
FIG 5
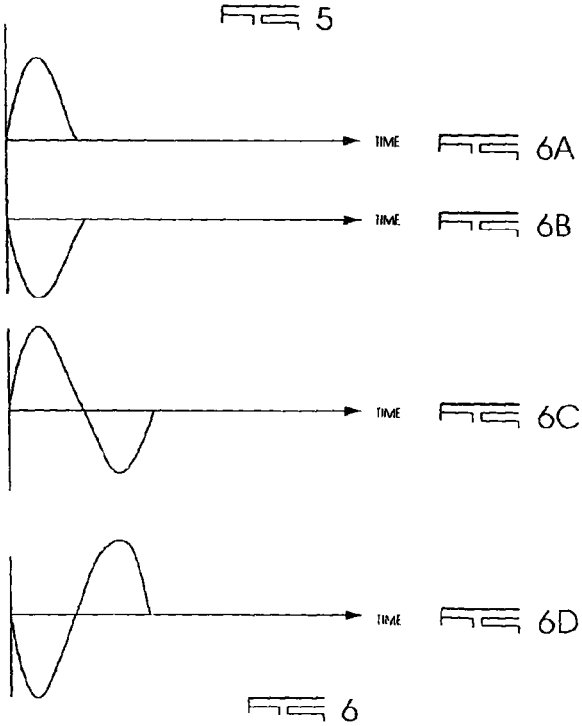
FIG 6A FIG 6B FIG 6C FIG 6D
FIG 6

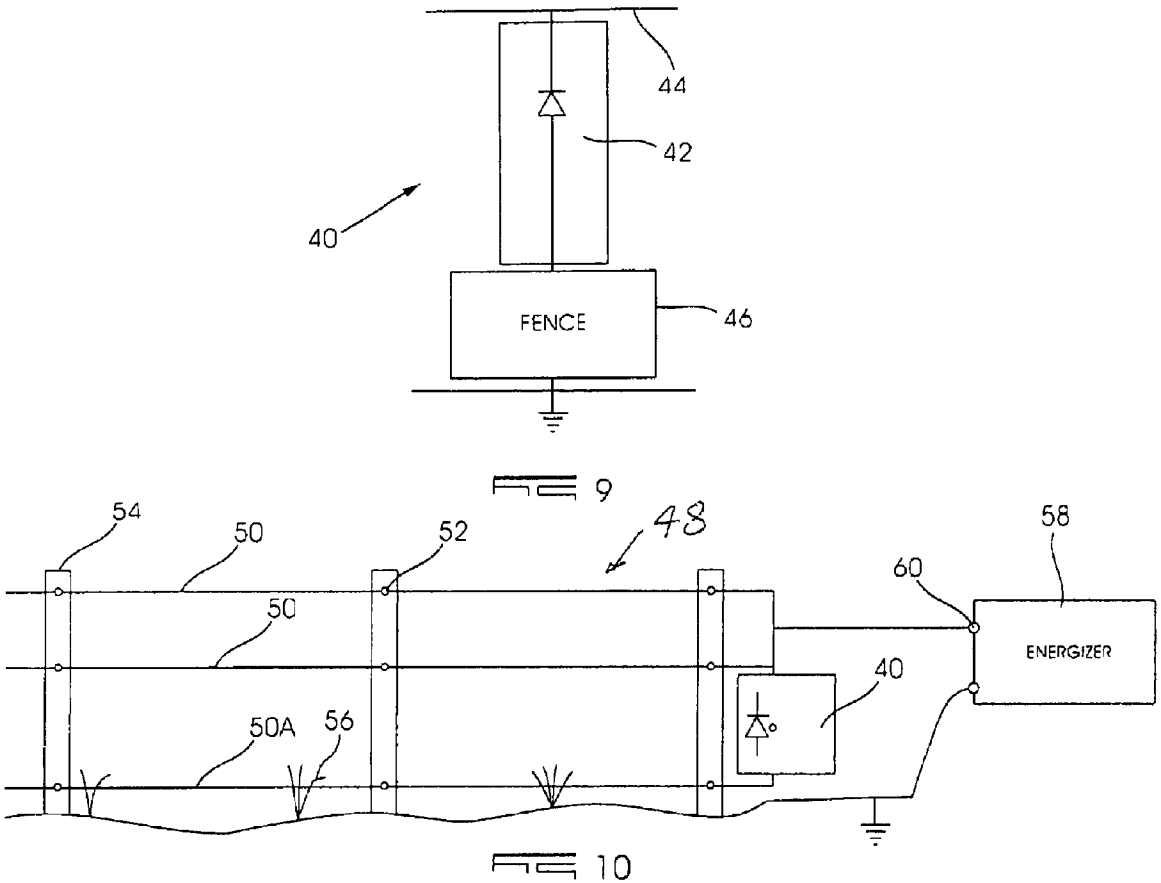
44
42
46
FENCE
40
9
48
58
ENERGIZER
60
40
52
56
50
50
50A
54
10

ELECTRIC FENCE ENERGISER SYSTEM

BACKGROUND OF THE INVENTION

This invention relates to the electrification of a fence e.g. for security or for the control of livestock and more particularly is concerned with enhancing the efficiency and safety of a fence energiser.

The electric fencing industry is highly competitive. Constant efforts are being expended by various parties to increase the effectiveness of energisers and to reduce the number of energisers required for a given application. The maintenance of an electric fence is also important and ongoing work is being done to reduce the amount of human intervention required to maintain an electric fence as an effective barrier.

A problem which is inherent in the control of an electric fence is that the output voltage of an energiser, in the order of 8000 volts, is difficult to switch in a cost-effective way without human intervention.

Many energisers have been proposed which generate unipolar outputs, primarily for historic reasons and because of circuit requirements.

WO03026362 proposes a bipolar output energiser for overcoming poor earthing conditions. Bipolar output energisers have also been described in international applications PCT/ZA2005/000179, PCT/ZA2005/000180 and PCT/ZA2006/000089.

It is known to design an energiser with more than one output terminal to enable different output energy levels to be offered. Mechanically operated, high voltage switches are often used in agricultural applications to enable a user to select a strand or fence to be energised. The use of a mechanically operated switch is labour intensive, inconvenient and undesirable.

An energiser which uses an electrically actuated switching arrangement is shown for example in AU 198547506. It appears though that a single output from an energiser is switched to different wires in a fence.

Various techniques have been suggested to increase the effective output energy of an energiser while still remaining within prescribed safety limits in order to reduce the number of energisers required for a given application. These include feedback schemes to increase the output energy of an energiser according to the loading of a fence to which the energiser is connected.

Prior art documents representative of the aforegoing include the following: AU198826906, NZ270570, WO88/10059, U.S. Pat. No. 6,020,658, NZ509061, WO00/35253, GB2403856 and PCT/2006/000089.

In many instances energiser safety has been increased significantly. It is observed however that to the applicant's knowledge it has not been possible to operate an energiser to compensate for unnecessary losses on a fence.

A delayed response energiser system has been proposed in GB2403856. However it falls short of a real-time measurement and real-time response electric fencing application.

An increase in energiser output energy raises concerns about the resulting safety to humans and animals. In some proposed real-time energy control mechanisms known to the applicant the cause of the increased fence losses has not been identified and the fence losses have not been minimised. For example it may happen that at a single point on a fence significant loading occurs and the whole fence is compromised. The applicant is unaware of a technique which enables the selective measurement of energy losses at different points along a fence to be effected and for such losses to be reduced or eliminated, without mechanical intervention.

A further complicating factor is that the losses incurred along a fence may not be linear due to the fact that very little loading takes place until ionisation of the air adjacent the fence occurs. Control algorithms known to the applicant attempt to maintain the fence voltage at a given set point. However, if it is possible to operate at a lower set point and simultaneously provide an adequate fence voltage level, losses in wasted energy can be substantially reduced. In this respect reference is made to FIG. 1 of the attached drawings which is a graph of fence energy losses versus fence voltage. It is seen that the losses increase exponentially with an increase in fence voltage. With this type of information a control algorithm can be used to choose a suitable operating point of, say, 5000 volts in order to ensure a minimum fence voltage of 3000 volts e.g. in an agricultural application.

Traditionally, as is shown in FIG. 2, an energiser 200 in an electric fence installation for a security application has a loop 202 for monitoring the voltage at an end 204 of a fence. The monitoring of the voltage at the end of the fence may also be used in agricultural applications. The return voltage is monitored and a control algorithm is used to try and maintain the voltage on the fence. A waveshape 206 of such an energiser is shown in FIG. 3. A disadvantage of such a system is that, should arcing occur at some point along the fence, at a certain voltage, any increase in voltage at the output terminals of the energiser will not increase the voltage at any point further along the fence from the arcing point.

FIG. 4 has a graph A of fence voltage against distance, with normal loading. A curve B shows the effect of an arc on a fence at a point X and of increasing the output voltage. FIG. 5 indicates the effect on the fence pulse 206. The total area (C+D) under the curve is proportional to the energy contained in the pulse. If there is no arcing the full pulse energy is available. The pulse energy is reduced to the portion C if there is arcing. It is apparent that by increasing the output voltage of the energiser very little is achieved in terms of available energy on the fence after the arcing point. The danger of a simple, closed-loop, voltage control when arcing is present on the fence is that the energy level at the output terminal may reach a potentially lethal value.

One method of overcoming an electric security fence is to connect the energiser output wires and return wires to one another. A portion of the existing fence is then removed. Clearly this activity affects fence energy consumption but, to the applicant's knowledge, this factor has not been used for alarm activation.

Another method of overcoming an electric security fence is to place or throw one or more lengths of bare wire, each in the shape of a hook, onto the fence. An electric security fence typically has alternate live and earth strands. Each wire then electrically short-circuits the strands of the fence making it possible to climb through the fence because the potential is effectively zero in close proximity to the location of the short circuit.

The invention aims to provide a selective fence energiser system which, at least partly, addresses the aforementioned problems.

SUMMARY OF INVENTION

The invention provides a method of controlling the operation of an energiser which delivers energy to a fence in the form of a succession of pulses, the method including the step of varying the energy or waveshape of each pulse in a manner which is dependent on the amount of energy which is lost by the fence for at least one pulse which is applied to the fence.

The method may include the step of determining the energy loss from the fence repeatedly, for each pulse in succession, or at selected intervals for one or more pulses, applied to the fence.

The method may include the step of relating the fence operating voltage to the energy losses. Thus the fence operating voltage may automatically be adjusted as a function of the energy losses from the fence.

The method may be implemented in respect of a complete fence or in respect of a selected strand or strands or sections of a fence.

The energy loss from the fence may be measured by using a first portion of a bipolar pulse of a first polarity and the fence may be energised by using a second portion of the bipolar pulse of a second polarity which is opposite to the first polarity.

In respect of a bipolar pulse a waveshape of a first portion of a first polarity of the pulse may be varied in a first way, and a waveshape of a second portion of a second polarity of the pulse may be varied in a second way which is different to the first way. The method may be such that total of the energy contained in the varied first portion and the energy contained in the varied second portion is below a predetermined value.

The invention also extends to a selective load energiser system for an electric fence which includes an energiser arrangement for applying a succession of pulses to the fence and a controller for varying the energy or waveshape of each pulse in a manner which is dependent on the amount of energy which is lost by the fence for at least one pulse which is applied to the fence.

The energiser arrangement may include one or more energisers which, preferably, are independently operable.

The controller may be used to modify the waveform of one or more of the pulses. The pulses may be selected from positive and negative polarity, unipolar pulses and bipolar pulses. In the latter case the bipolar pulses may be symmetrical or asymmetrical.

Unipolar pulses of alternating polarity may be generated at chosen intervals and used to excite a fence from alternate ends. A bipolar pulse, of total energy kept within a prescribed limit, can be used to excite the fence at regular intervals. Effectively the fence is alternately pulsed, at regular intervals, from opposing ends with half the energy. The bipolar pulse may be symmetrical, or asymmetrical.

The controller may be adapted to measure energy losses from the fence using a first part of a first polarity of a bipolar pulse and to energise the fence using a second part of a second polarity, opposite to the first polarity, of the bipolar pulse.

The controller may include a unidirectional current conductor. The unidirectional current conductor may comprise one or more diodes assembled in series to achieve a desired blocking voltage. Alternatively the unidirectional current conductor may include an active device which is switchable. This type of device, e.g. a thyristor or another type of semiconductor switch or any equivalent device, enables real-time energy losses from a fence to be assessed and real-time adjustments to be made to energy output levels.

The energiser system of the invention can operate in different modes. In one mode a plurality of wires in a fence are energised simultaneously. In another mode at least one wire is energised at an energy level which differs from the energy level at which the other wires are energised.

It further falls within the scope of the invention to operate in a third mode and to energise some of the wires in a fence with positive pulses, some wires with negative pulses and some wires with bipolar pulses.

BRIEF DESCRIPTION OF THE DRAWINGS

The invention is further described by way of examples with reference to the accompanying drawings in which:

FIGS. 1 to 5 have already been referred to in the preamble hereof,

FIG. 6 has four curves of fence voltage versus time, namely: FIG. 6A which depicts a positive pulse, FIG. 6B which depicts a negative pulse, FIG. 6C which depicts a bipolar pulse with a positive leading edge, and FIG. 6D which depicts a bipolar pulse with a negative leading edge, FIG. 9 shows a load selective block for use in the energiser system of the invention, FIG. 10 illustrates an application of the load selective block of FIG. 9 in a typical fence.

DESCRIPTION OF PREFERRED EMBODIMENTS

In the accompanying drawings FIGS. 1 to 5 have already been alluded to and are not further discussed herein.

FIGS. 6A to 6D respectively show different energiser output pulses, namely a positive pulse, a negative pulse, a bipolar pulse with a positive leading edge, and a bipolar pulse with a negative leading edge. These pulses are considered as single pulses in this specification. These pulses can be generated in various ways using full bridge and half-bridge topologies.

Figure 1:
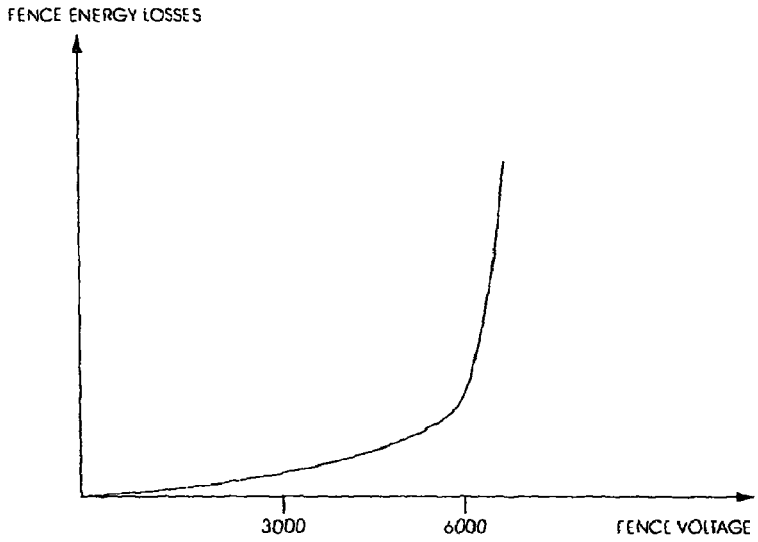
Figure 2:
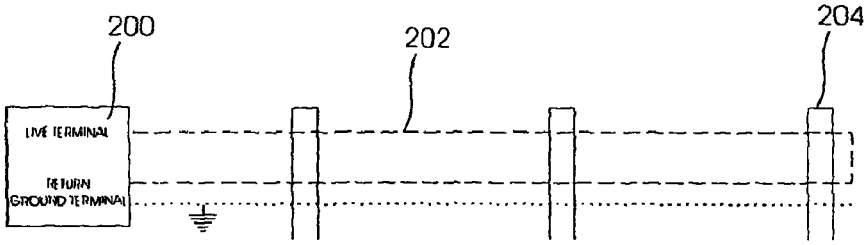
Figure 3:
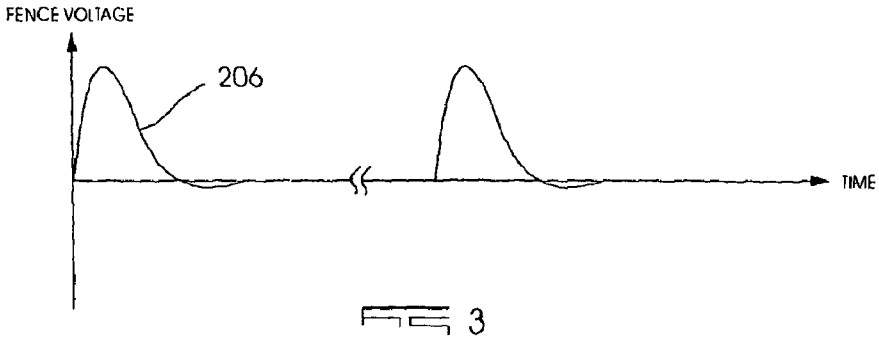
Figure 7:
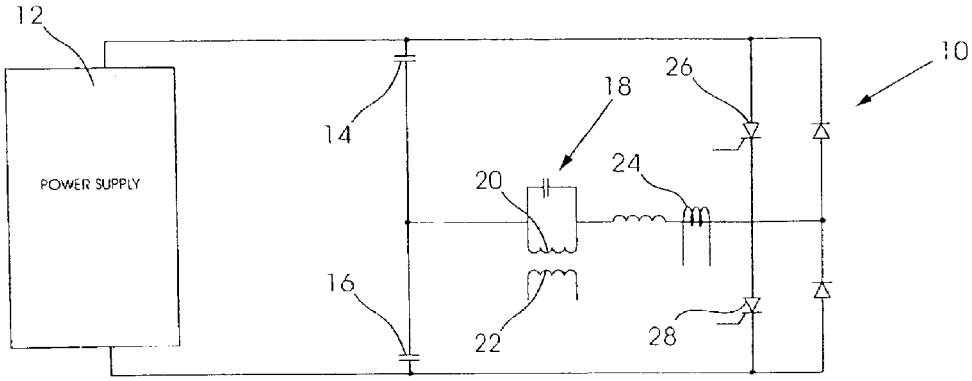
FIG. 7 shows a half-bridge topology energiser.

FIG. 7 depicts an energiser circuit 10 which has a power supply 12, capacitors 14 and 16 respectively, a resonance circuit 18 with an output winding 20 linked to a winding 22 which in turn is connected to a fence, not shown, to be energised, a zero-crossing current transformer detector 24, and thyristors 26 and 28 which are switched by means of a control circuit, not shown.

The power supply 12 is used to charge the capacitors and each capacitor is discharged, in turn, by firing the thyristors 26 and 28 alternately. The transformer constituted by the windings 20 and 22 is excited in two quadrants and the option is available to switch the second thyristor 28 when the load current passes through zero (this is detected by the zero-crossing detector 24) and so achieve efficiencies in the order of 90%. This can be considered as a resonant mode energiser. By changing the number of negative pulses generated compared to the number of positive pulses generated, or vice versa, asymmetrical output waveforms can be generated by the energiser.

Figure 8:
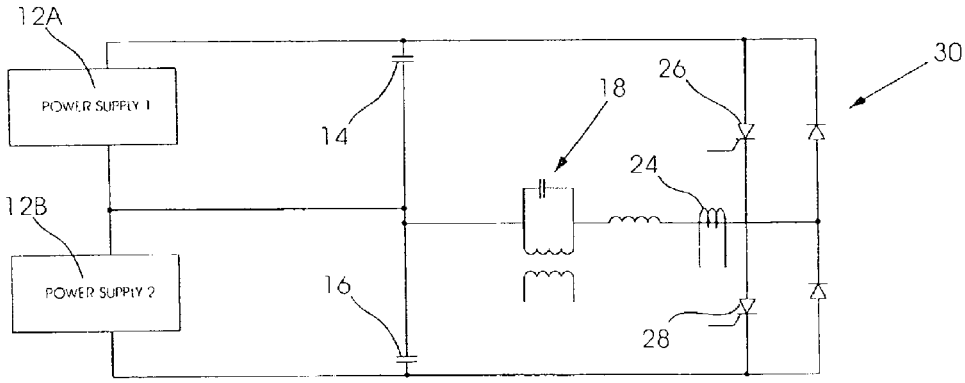
FIG. 8 shows an arrangement which can generate arbitrary output waveforms for each pulse.

FIG. 8 shows an energiser 30 which is similar in many respects to the energiser 10 except that separate power supplies designated 12A and 12B respectively are used to charge the capacitor 14 and the capacitor 16, respectively. This arrangement allows the voltages across the capacitors 14 and 16 to be independently controlled and this in turn allows the energiser to output waveforms of arbitrary shapes and energy contents.

FIG. 9 shows a load selective block 40 which is used in an energiser system of the invention. The block includes, in its simplest form, a plurality of diodes 42 (only one diode is shown), connected in series. The number of diodes used is determined, at least, by the breakdown voltage of each diode and the operating fence voltage. Also taken into account is the voltage which is to be applied to a strand or wire 44 of a fence. The block is connected between a selected strand or strands 44 and a known resistor or another section of the fence, collectively designated 46.

Reference is made to FIG. 10 which depicts a fence 48 consisting of a number of live strands 50 supported on insulators 52 which in turn are fixed to posts 54. A lowermost strand or wire designated 50A is exposed to vegetation 56 which, as is known, results in energy losses when in contact with the wire 50A.

The wires 50 are energised by an energiser 58 of appropriate construction. The upper wires are directly connected to a live output 60 and hence are pulsed at a normal operating voltage. A load selective block 40 of the kind shown in FIG. 9 is connected between the live output and the lowermost wire 50A and, consequently, the lower wire 50A is energised at a lower level.

Under these conditions if a pulse of the kind shown in FIG. 6A is applied to the fence then the losses caused by the bottom strand are not detrimental to the remainder of the fence and an effective barrier is maintained. Another benefit from this approach is that it is possible to operate by not energising certain portions of a fence, for example if children are in close proximity to the fence. This enhances the safety of operation.

Figure 11:
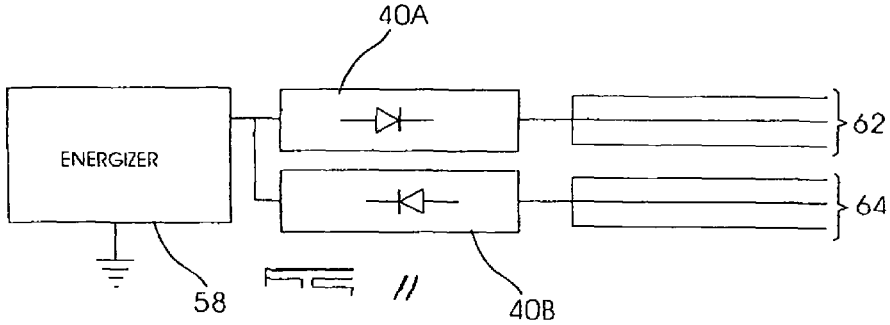
FIG. 11 depicts the differential application of pulses to selected strands in a fence.

In an agricultural application, for example, it is possible through the use of the energiser system shown in FIG. 11 to define selective grazing areas. In this case an energiser 58 is connected via two load selective blocks 40A and 40B respectively to selected strands 62 and 64 of a fence. For the sake of distinction the strands 62 are referred to as even strands while the strands 64 are referred to as odd strands. The load selective blocks 40A and 40B have different polarities. In this case the even strands are exclusively energised by generating a waveform of the type shown in FIG. 6A while the odd strands are exclusively energised by generating a waveform of the kind shown in FIG. 6B. It is possible to energise all strands by using the waveform shown in FIG. 6C, or in FIG. 6D.

A security fence typically has alternate earth and live fence strands. If even and odd strands are wired alternately with earth strands, and the waveform shown in FIG. 6C or FIG. 6D is used to excite the fence, a degree of security is maintained because the short-circuiting of any live strand to earth only has a detrimental effect on half of the live strands.

Referring again to the example illustrated in FIG. 10 it is possible to make use of the selective loading principle in a more efficient and intelligent manner in response to certain load conditions. For example, during a rain shower the excitation of the bottom strand 50A may be stopped altogether. Such excitation is only recommenced once the vegetation 56 has been given an adequate opportunity to dry.

Figure 12:
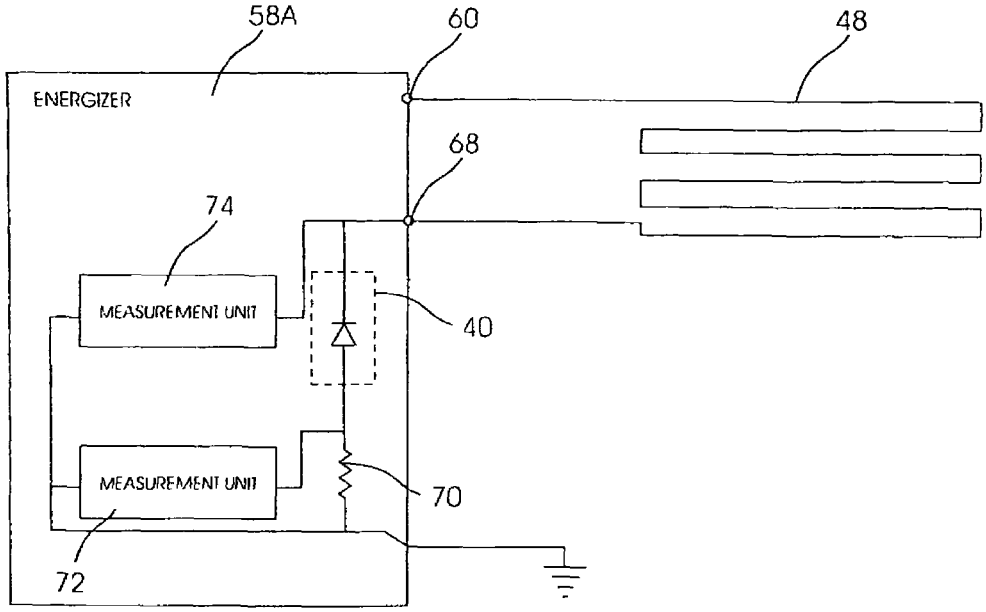
FIG. 12 illustrates a circuit for measuring energy losses in a fence.

FIG. 12 depicts an energiser 58A with a live output terminal 60 connected to a fence 48. The fence is also connected to a return fence terminal 68 on the energiser.

The energiser includes a load selective block 40 of the type shown in FIG. 9 in series with a known resistance 70. A measurement unit 72 which can measure the root mean square (RMS) voltage across the resistor 70 is included in the energiser. Similarly, a second measurement unit 74 which measures fence voltage is connected between the return fence terminal and earth.

By measuring the RMS voltage across the resistor 70 the power dissipated in the resistor can be calculated. The energy which is dissipated in the load can then be calculated.

The energiser output energy (applied to the fence 48) is known either by characterisation or by means of energiser measurement circuitry. What are generally not known are the energy losses along the fence.

Assume that the energiser generates a negative pulse of the type shown in FIG. 6B. This pulse is used to excite the fence as well as the known load resistance 70. Because the energiser output energy is known and the energy dissipated in the known load resistance is measured the actual energy lost in the fence can be calculated as follows: energy loss in fence=energiser output energy energy dissipated in known load resistance.

Figure 13:
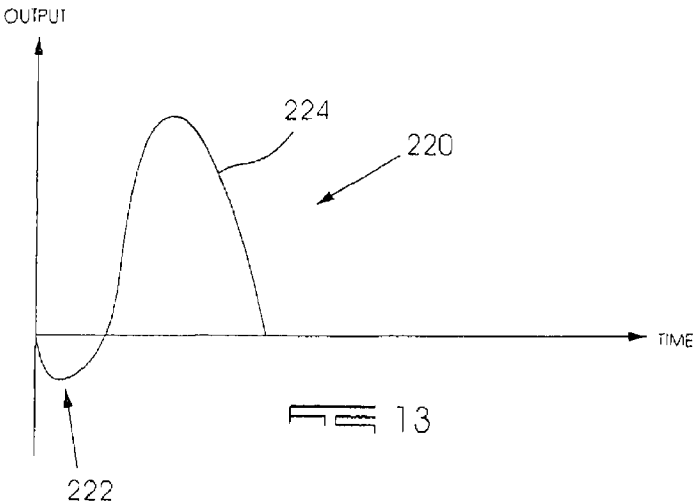
FIG. 13 shows an asymmetrical bipolar pulse.

If the waveform shown in FIG. 6D were to be applied to the fence the first part of the waveform could be used for calculating the energy loss in the fence and the second part of the waveform could be used for exciting the fence. It is possible to generate the waveform in FIG. 6D asymmetrically as is shown, for example, in FIG. 13 to produce a bipolar pulse 220 with a negative leading edge which has a small negative component 222 and a relatively large positive component 224. In this approach the amount of energy wasted in the known load resistance can be reduced. Alternatively the energy losses of the fence can be determined at different fence voltages.

If any non-linearities occur as a function of fence voltage the operating point of the energiser can be chosen slightly below the point of significant losses and the energy efficiency can thereby be greatly enhanced.

By suitable choice of waveforms the energy loss calculation of the fence can be done for each energiser pulse or at selected intervals, according to requirement.

In order for the fence energy loss measurements to be accurate it is desirable for the known resistance 70 to have a resistance value which is comparable to the expected equivalent loss resistance of the fence. A disadvantage, however, is that comparable amounts of energy would be wasted in the fence, and in the measurement resistance. However, as has been pointed out, the invention allows the measurement of fence losses to be done at will according to requirement. For example, in a security fence application it may be desirable to monitor the fence energy consumption during each pulse in order to detect tampering with the fence. On the other hand in an agricultural application the fence energy consumption would only be measured at extended intervals, for example only every thirty minutes. Again it is pointed out that in an agricultural application use can be made of other sensors, e.g. rain sensors, so that portions of a fence are automatically disconnected when increased losses are expected in order to curtail such losses. Seasonal variations can also be catered for automatically.

The energiser system of the invention enables the energy loss along the fence to be determined on a pulse-by-pulse basis. If the fence losses are significant the output energy of the energiser can be increased accordingly. The first part of the waveform is used for determining the fence losses. If the first part of the waveform is controlled to be within prescribed energy limits then the safety of the system can be greatly enhanced by not generating the second part of the waveform if the losses along the fence have changed significantly between pulses.

Through the choice of appropriate waveforms the load selective block 40 and the known resistance 70 need not present an additional load to the fence and consequently there is no disadvantage in using the system of the invention.

Figure 14:
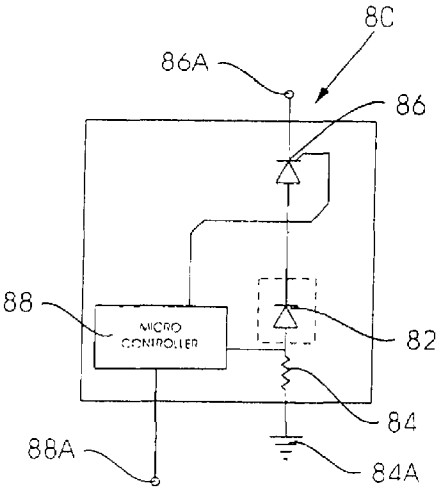
FIG. 14 depicts an intelligent version of the load selective block shown in FIG. 9.

FIG. 14 shows an intelligent load selective block 80 which includes a plurality of diodes 82 connected in series with each other and in series with a known resistance 84 and connected to earth 84A, and a thyristor 86 connected to a live output terminal 86A. A microcontroller 88 is used to switch the thyristor in a controllable manner. This allows the load selective block 80 to be brought into operation, when required. The microcontroller has a communication port 88A.

Figure 15:
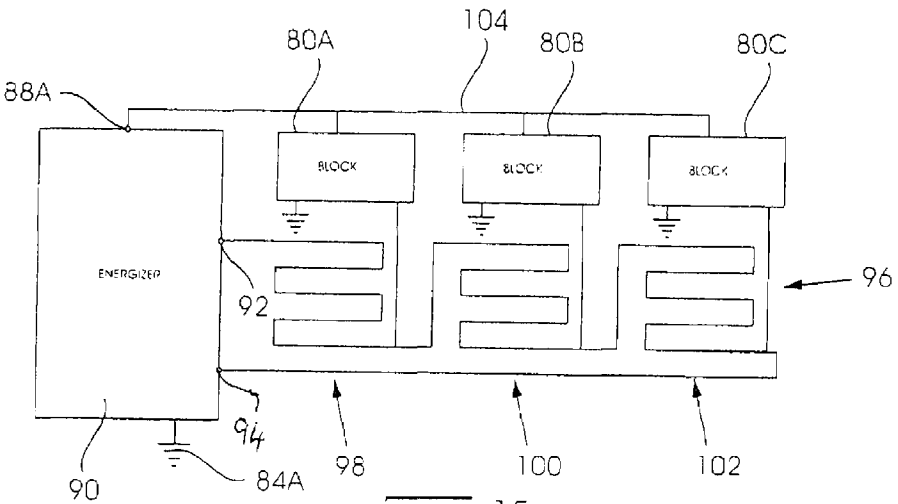
FIG. 15 depicts the use of a plurality of the intelligent load selective blocks, shown in FIG. 14, in the selective energisation of a fence.

FIG. 15 shows an energiser 90 with a live output terminal 92 and a return terminal 94 connected to a fence 96 which is divided into a number of zones 98, 100, 102 etc. Each zone has a respective, intelligent load selective block 80A, 80B, 80C connected to it. A communication medium or circuit 104 is connected to the fence and to a communication port 88A of the energiser.

This approach makes it possible for the load selective blocks to be activated at selected times according to requirement. For example, if the thyristor in the load selective block 80A is fired on the occurrence of a fence pulse and the thyristor in the load selective block 80B is fired on the occurrence of a subsequent pulse, and so on, then the respective measured energy levels can be communicated via the communication link to the energiser. The energy losses of different sections of the fence can then be individually calculated and displayed, for example on a touch-screen LCD display with graphic information about the fence losses. This display could include user-selectable energiser options on a menu and this would enable a user to energise each section of the fence in a manner which is dependent on the load losses in such section.

The communication link 104 could be any suitable device, for example a fibre optic network or a radio link. It is also possible to effect communications via the fence wires.

Figure 16:
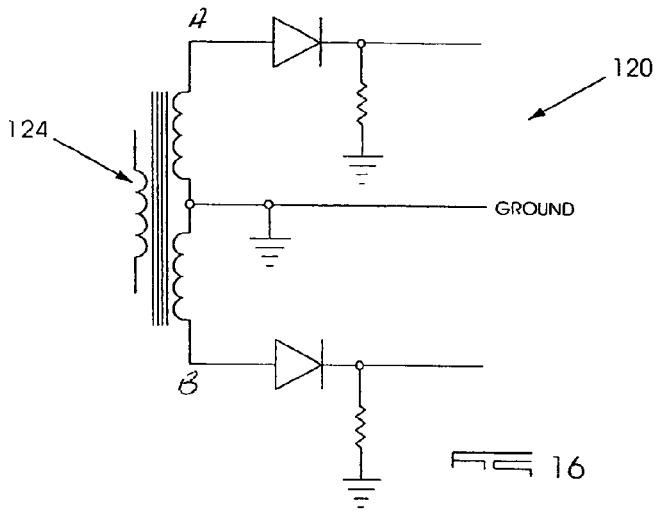
FIG. 16 shows a modified energiser.
Figure 23:
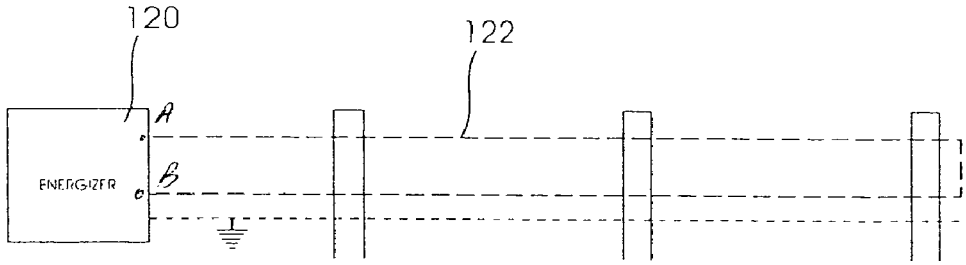
FIG. 23 shows a different installation format for a security fence.

Consider an energiser 120 which can generate pulses of either polarity, depicted in FIG. 16, and connected to a fence 122 as illustrated in FIG. 23. The energiser has an output transformer 124 connected to terminals A and B, and to ground.

Figure 17:
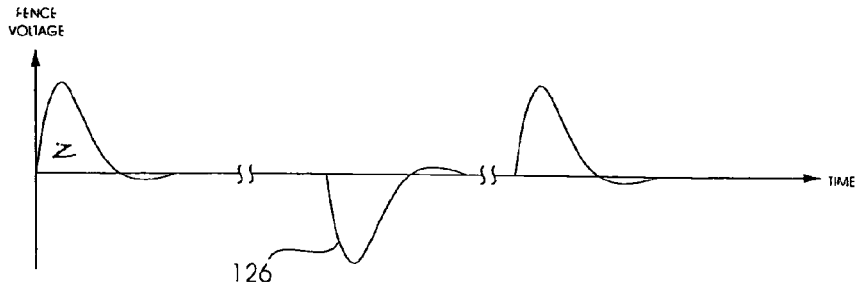
FIG. 17 shows a possible pulse waveform.
Figure 18:
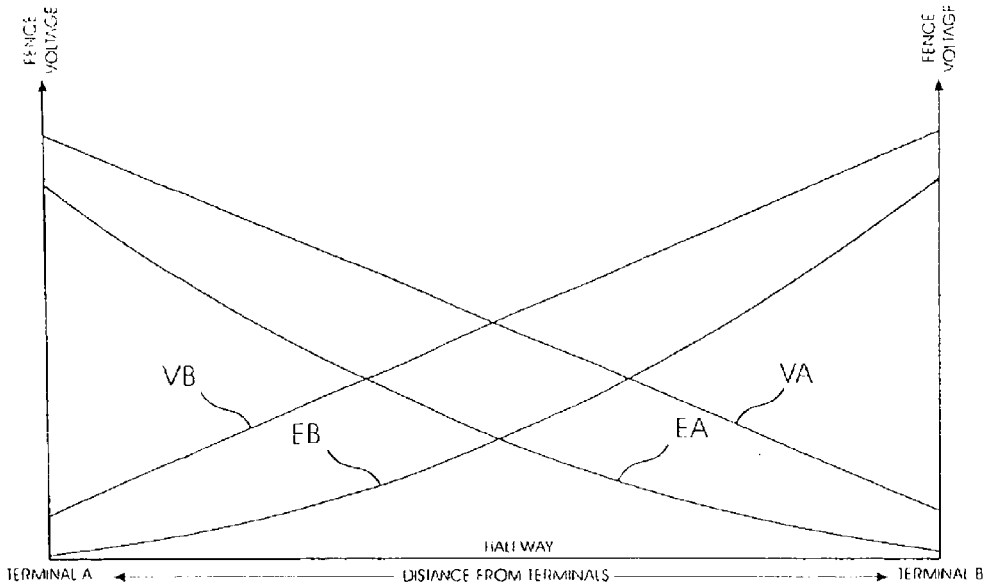
FIG. 18 illustrates curves of fence voltage and pulse energy for a fence excited alternately from opposing ends.

If unipolar pulses 124 of alternating polarity are generated once a second then the voltage at the output terminals of the energiser is as shown in FIG. 17. Every second a positive pulse is generated either at terminal A or terminal B of the energiser. The fence receives excitation from one end and a second later the fence is excited from the other end. The voltage drop along the length of the fence is principally a function of series resistance and fence loading. The slope of the line A, shown in FIG. 4, changes as a function of these parameters. As the fence is excited from both sides at terminal A and terminal B, on alternate intervals, typically of 1 second duration, the curves which are shown in FIG. 18 become applicable, although in practice the voltage along a fence may vary due to reflections along the fence. FIG. 18 shows that the fence voltage VA or VB drops linearly along the fence as the distance from terminal A, or terminal B, as the case may be, increases. The available energy on the fence, designated EA and EB for each case, is generally dependent on the square of the voltage.

Figure 19:
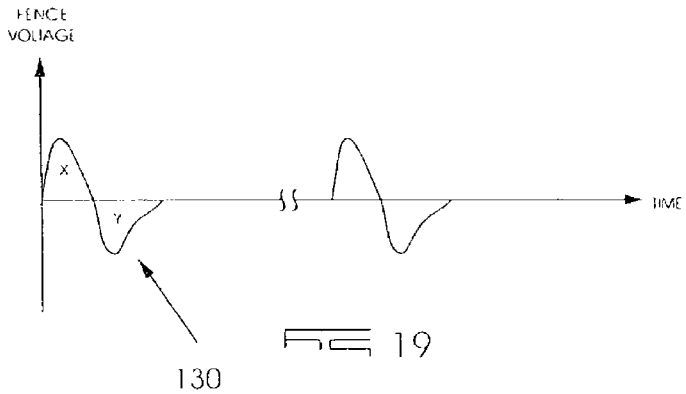
FIG. 19 shows a largely symmetrical bipolar pulse waveform.
Figure 20:
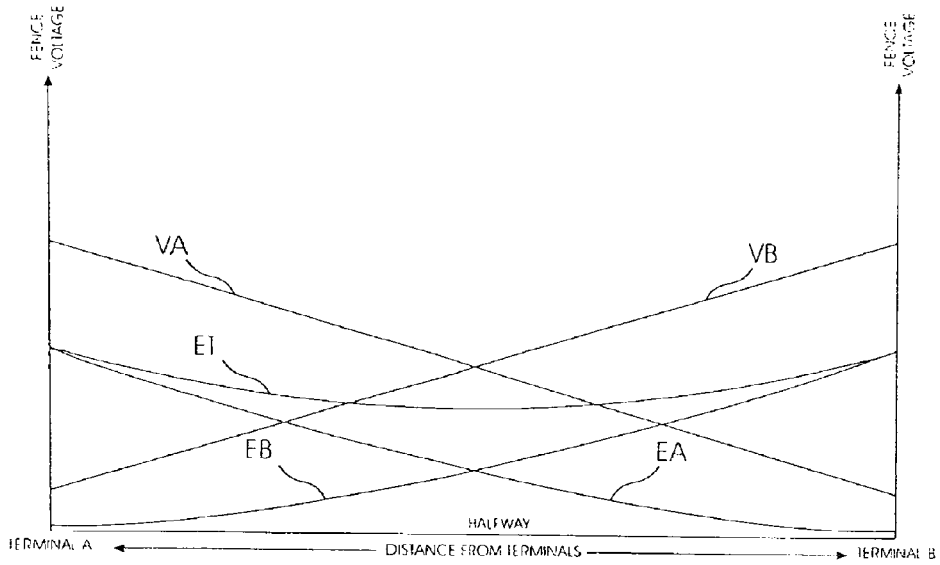
FIG. 20 is similar to FIG. 18 for a different exciting pulse.

A bipolar pulse 130, and not a unipolar pulse, can however be each generated for each interval. This is shown in FIG. 19. The combined energy represented in areas X and Y in FIG. 19 must be equivalent to the area Z shown in FIG. 17 to remain within prescribed energy limitations. This waveform is used to excite the fence once per second. Effectively the fence is pulsed, once a second, from alternate ends, with half the energy. FIG. 20 is applicable and shows that EA is the energy available along the fence from the energiser terminal A, and EB is the energy available from the energiser terminal B. ET is the combined terminal energy available along the fence.

Figure 21:
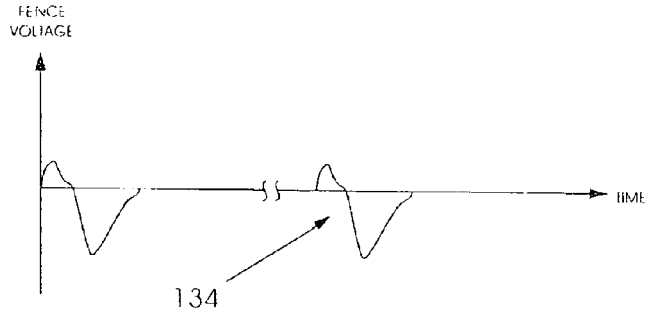
FIG. 21 shows an asymmetrical bipolar pulse waveform.

The energiser 120 is also capable of generating asymmetrical bipolar waveforms 134 as depicted in FIG. 21. If, for example, an arc occurs on the fence such that the breakdown voltage is in the order of 2 kv at point Y in FIG. 22, then a control algorithm of the energiser 120 is such that it increases the terminal voltage of both terminals as a function of time and measures the terminal output energy and end of fence energy at the other terminal. The onset of arcing is detected due to the associated energy losses. The optimal operating voltage of terminal A, and corresponding output energy, are determined. The total allowable energy of the waveform is specified, and the energy of terminal B can be increased accordingly.

Figure 22:
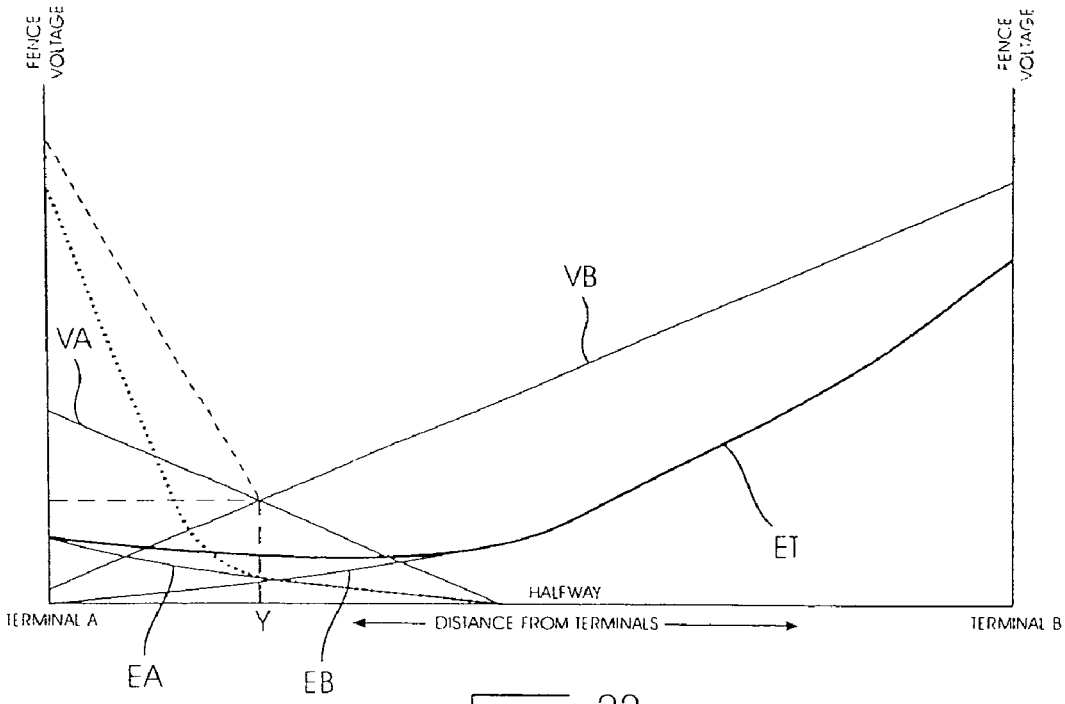
FIG. 22 illustrates an effect of a fault condition.

The efficiency of energy transfer from the other terminal is also monitored and, provided no non-linearity is detected, the operating voltage is determined from energy constraints. FIG. 22 shows what can happen under these circumstances.

The techniques described with reference to FIGS. 16 to 23 allow for the operation of an energiser that has significant advantages in terms of energy efficiency and safety over what would have happened using a traditional energiser approach with the characteristics as described with reference to FIGS. 4 and 5. Fence faults can still be monitored by energy measurements done by means of analogue to digital converters:

An indication of the position of an arc can be determined as follows:

(1) if EA (at terminal A)<EB (at terminal B)
then distance to fault from terminal A=EA (at terminal A)/EB(at terminal B)*fence length; and (2) if EA (at terminal A)>EB (at terminal B)
then distance to fault from terminal B=EB(at terminal B)/EB(at terminal A)*fence length; and (3) if EA=EB then there is no arcing or else arcing is taking place at the centre of the fence.

The invention claimed is:

1. A method of controlling the operation of an energiser which delivers energy to a fence in the form of a succession of pulses, the method including the step of varying the energy or waveshape of each pulse in a manner which is dependent on the amount of energy which is lost by the fence for at least one pulse which is applied to the fence.

2. A method according to claim 1 which includes the step of determining the energy loss from the fence repeatedly, for each pulse in succession, or at selected intervals for one or more pulses, applied to the fence.

3. A method according to claim 1 which includes the steps of relating the fence operating voltage to the energy loss and of automatically adjusting the fence operating voltage as a function of the energy loss from the fence.

4. A method according to claim 1, wherein the energy loss from the fence is measured by using a first portion of a bipolar pulse of a first polarity and the fence is energised by using a second portion of the bipolar pulse of a second polarity which is opposite to the first polarity.

5. A method according to claim 1, wherein, in respect of a bipolar pulse, a waveshape of a first portion of a first polarity of the pulse is varied in a first way, and a waveform of a second portion of a second polarity of the pulse is varied in a second way which is different to the first way.

6. A method according to claim 5 which includes the step of controlling the total of the energy contained in the varied first portion and the energy contained in the varied second portion to below a predetermined value.

7. A selective load energiser system for an electric fence which includes an energiser arrangement for applying a succession of pulses to the fence and a controller for varying the energy or waveshape of each pulse in a manner which is dependent on the amount of energy which is lost by the fence for at least one pulse which is applied to the fence.

8. A system according to claim 7 wherein the controller is used to modify the waveform of one or more of the pulses which are selected from positive and negative polarity unipolar pulses and symmetrical and asymmetrical bipolar pulses.

9. A system according to claim 7, wherein the controller measures energy losses from the fence using a first part of a first polarity of a bipolar pulse and energises the fence using a second part of a second polarity, opposite to the first polarity, of the bipolar pulse.

10. A system according to claim 7 wherein the controller includes a unidirectional current conductor which is selected from one or more diodes assembled in series to achieve a desired blocking voltage, and an active switchable device.

11. A system according to claim 7 wherein the controller includes an active switchable device which enables real-time energy loss from a fence to be assessed and real-time adjustments to be made to an energy output level of the energiser arrangement.

12. A system according to claim 7, which is operable in a mode selected from the following:

a first mode wherein a plurality of wires in a fence are energised simultaneously;

a second mode wherein at least one wire in a fence is energised at an energy level which differs from the energy level at which other wires in the fence are energised; and a third mode in which the energiser arrangement is used to energise some wires in a fence with positive pulses, some wires with negative pulses and some wires with bipolar pulses.

13. A system according to any claim 7, wherein the fence is alternately excited from opposing ends.

14. A system according to claim 13 wherein the excitation takes place with a succession of unipolar pulses.

15. A system according to claim 13 wherein the excitation takes place with a succession of bipolar pulses and wherein the energy within each pulse is below a predetermined value.

16. A system according claim 15 wherein the bipolar pulses are generated in an asymmetrical form in response to an arc on the fence.

* * * * *